US005957448A

United States Patent [19]

Frank et al.

[11] Patent Number: 5,957,448

[45] Date of Patent: Sep. 28, 1999

[54] DEVICE AND PROCESS FOR INTERMEDIATE STACKING OF ITEMS

[75] Inventors: Werner Frank, Insel Reichenau; Holger Schererz; Gerhard Obier, both of Berlin, all of Germany

[73] Assignee: Siemens Aktiengesellschaft, Munich, Germany

[21] Appl. No.: 09/091,669

[22] PCT Filed: Dec. 18, 1996

[86] PCT No.: PCT/EP96/05682

§ 371 Date: Jun. 18, 1998

§ 102(e) Date: Jun. 18, 1998

[87] PCT Pub. No.: WO97/22425

PCT Pub. Date: Jun. 26, 1997

[30] Foreign Application Priority Data

Dec. 19, 1995 [DE] Germany ..... 195 47 292

[51] Int. Cl.[6] ..... B65H 1/02; B65H 1/24

[52] U.S. Cl. ..... 271/152; 271/148; 271/149

[58] Field of Search ..... 271/148, 149, 271/152, 154; 414/798.9, 801

[56] References Cited

U.S. PATENT DOCUMENTS

| | | | |
|---|---|---|---|
| 3,690,474 | 9/1972 | Klappenecker . | |
| 4,302,000 | 11/1981 | Frank | 271/148 X |
| 4,523,753 | 6/1985 | Hiromori et al. | 271/149 X |
| 4,757,985 | 7/1988 | Hamant et al. | 271/149 X |
| 5,335,899 | 8/1994 | Golicz | 271/149 X |
| 5,409,207 | 4/1995 | Freeman | 271/181 |

FOREIGN PATENT DOCUMENTS

| | | |
|---|---|---|
| 1402602 | 5/1965 | France . |
| 1495860 | 8/1967 | France . |
| 1235818 | 3/1967 | Germany . |

*Primary Examiner*—Janice L. Krizek
*Attorney, Agent, or Firm*—Venable; George H. Spencer

[57] ABSTRACT

A device for intermediate stacking of letters (SE) with a stacking roller (SR), stacking carriage (SW), underlying belt (UB) and a separation device. The stacking roller (SR) is mounted on the stacking carriage (SW) and a pressure gauge is provided in the vicinity of the stacking roller to measure the pressure of the stack against the pressure gauge. A device is provided for detecting possible slants in the letter stack (ST); that where such a slant is detected, the stacking carriage (SW) and/or underlying belt (UB) are made to move until the slant is eliminated; that the stacking carriage (SW) should be displaced along the underlying belt (UB) until the letter stack (ST) exerts a certain pressure on the pressure gauge provided that the detecting device does not report the presence of a slant.

9 Claims, 2 Drawing Sheets

DEVICE AND PROCESS FOR INTERMEDIATE STACKING OF ITEMS

Figure 1:
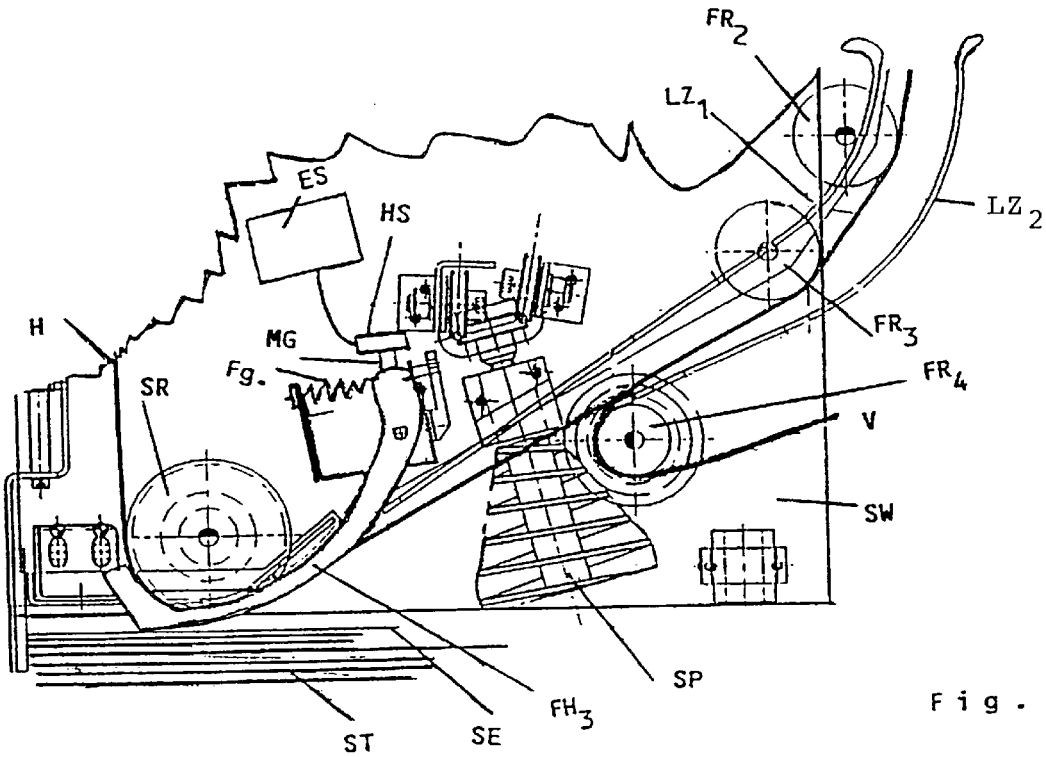

The present invention concerns a device and a process for the intermediate stacking of items, in particular in letter processing systems.

Such intermediate stacking devices are used, for example, in letter-sorting facilities as a connecting link between segments containing rough sorting compartments and precise sorting machines. The intermediate stacking device in this case buffers the irregularly arriving items, such that the precise sorting machine can be stressed evenly.

With a known intermediate stacking device, the individual items to be stacked are conveyed while clamped between a front belt and a rear belt near the stacking location, where a stack of items already exists or is formed by the items to be stacked. The stack is formed in that the items are conveyed individually, one after another, with their front edge to a stacking wall. For this, the front belt is removed from the item at a certain distance from the stacking wall and, owing to its inertial mass, the item continues to move in the direction of the stacking wall along a guide rail. With the aid of a rotating stacking roller, e.g. driven by the rear belt, the item is finally conveyed into the space between the stack of items and the stacking roller and is then transported further to the stacking wall.

The items in the stack of items rest with their lower edges on an underlying belt, crosswise to its movement direction, which belt can be moved along the stacking wall. A separating device is provided on the side of the stack that is located opposite the stacking roller, which device can withdraw the items one after another from the stack of items for further processing.

The underlying belt is moved in the direction of the separating device, in such a way that the stack fits closely against the separating device so that the item closest to the separating device can be withdrawn. In the stacking region, the stacking roller must be positioned such that the items to be stacked can be transported without a problem between the stacking roller and the stack to the stacking wall.

In known intermediate stacking devices, the stacking carriage with the stacking roller is moved in the direction of the separating device owing to a mechanical coupling of the stacking carriage with the underlying belt. Thus, during the removal of items by the separating device, the underlying belt and therefore also the stacking carriage with the stacking roller are moved in the direction of the separating device.

A three-phase motor with electromagnetic clutch is provided for stacking the items. Depending on the item to be stacked, this motor moves the stacking carriage with the stacking roller along the underlying belt in the opposite direction as the withdrawing roller. A lever is arranged near the stacking roller, and the stack pushes onto this lever. The lever then actuates a proximity sensor, which gives off a signal for switching the clutch and thus also for a movement of the stacking carriage toward the back, that is in the direction away from the withdrawing roller, as soon as a specific minimum pressure acts upon the lever. The clutch is disengaged again as soon as a specific minimum pressure is not reached, and the stacking carriage remains in the position it is in at the time.

This intermediate stacking device has the disadvantage that the stack of items can topple over if the items have irregular thickness or if they are particularly heavy and tall, thus omitting the function of the intermediate stacking device.

It is therefore the object of the invention to ensure a trouble-free operation of the intermediate stacking device, even for unevenly thick items or particularly heavy, tall items.

This object is solved in accordance with the invention with an intermediate stacking device having the features as in claim 1.

Advantageous modifications and embodiments of the invention follow from the dependent claims.

The intermediate stacking device according to the invention comprises a stacking roller, a stacking carriage, an underlying belt, a separating device, a pressure measuring device located near the stacking roller for measuring the pressure exerted by the stack on the pressure measuring device and a device for detecting slanted positions of the stack of items.

The stacking roller is arranged on the stacking carriage. The stacking carriage can be moved along the underlying belt with the aid of a drive. The separating device is arranged at one end of the underlying belt. With the aid of the stacking roller rotating around its axis, the individual items to be stacked are conveyed to a stacking wall, one after another and between the stacking roller and the already stacked items, and are subsequently positioned on the underlying belt such that they are crosswise to its movement direction.

The separating device at the other end of the stack can withdraw the item that respectively fits close against it, and can thus reduce the stack size once more. The intermediate space, which has opened up in that location, is closed again by moving the underlying belt in the direction of the separating device. The stacked items increase the pressure exerted by the stack onto the pressure measuring device, arranged near the stacking roller.

The withdrawn items and thus the movement of the underlying belt in the direction of the withdrawal roller reduce the pressure exerted on the pressure measuring device. The stacking carriage is respectively moved until the optimum stack pressure for a stacking is reached.

The device for detecting slanted stack positions monitors the stack of items. If the device signals a slanted position, an electronic control circuit controls the stacking carriage and/or the underlying belt in such a way that the slanted position is corrected. The information from the pressure measuring device is ignored until the slanted position is corrected.

If the stack is slanted toward the front, meaning if the upper edge of the items is farther away from the stacking roller than the lower edge, the stack is preferably straightened again through a brief forward movement of the underlying belt, that is to say in the direction of the separating device. If the stack is slanted toward the back, the stack is preferably straightened again by moving the underlying belt and the stacking carriage forward. In accordance with the invention, the stacking carriage therefore moves toward the front or toward the back, depending on the pressure measuring device, as long as no slanted position is reported.

It is particularly advantageous if the device for detecting the slanted position is configured with two levers, arranged one above the other, which are respectively pushed against the stack of items and which respectively actuate one switch, wherein the switching points for the switches are located on a line that is perpendicular to the underlying belt plane and a slanted position is identified if the switches display different switching points.

It is furthermore particularly advantageous to provide a third lever as a component of the pressure measuring device, which lever is positioned vertically the same way as the two levers for the particularly preferred device to detect the slanted positions, to provide the third lever with a carrier stop and to provide the two other levers with a carrier, and design the third lever the same way as the two other levers, with the exception of the carrier stop and the carriers. On the one hand, the two levers can be used to detect slanted stack positions and, on the other hand, they can simultaneously help determine the pressure: If one of the two levers is stressed more than the third lever, it transmits the pressure via its carriers to the carrier stop of the third lever and thus deflects this lever, so that the lever with the highest stress determines the deflection of the third lever.

It is furthermore especially advantageous to use an analog sensor for measuring the deflection of the third lever, which makes it possible in a particularly advantageous way to adjust the movement speed in dependence on the position of the third lever for an optimum stacking.

Finally, it is advantageous if a withdrawal roller, a withdrawal belt or several withdrawal belts are used as separating device.

The invention is explained further in the following with the aid of drawings of an especially preferred embodiment.

Figure 2:
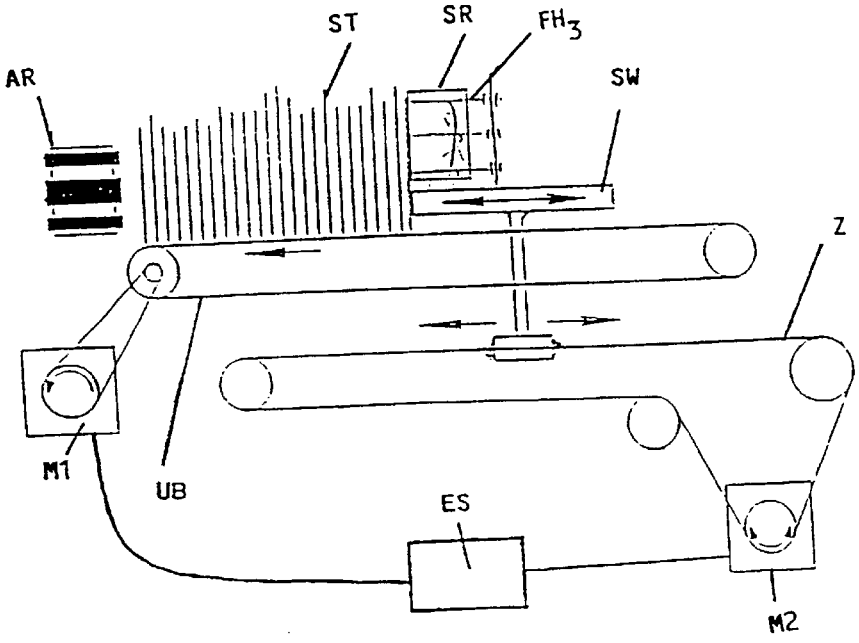
Figure 3:
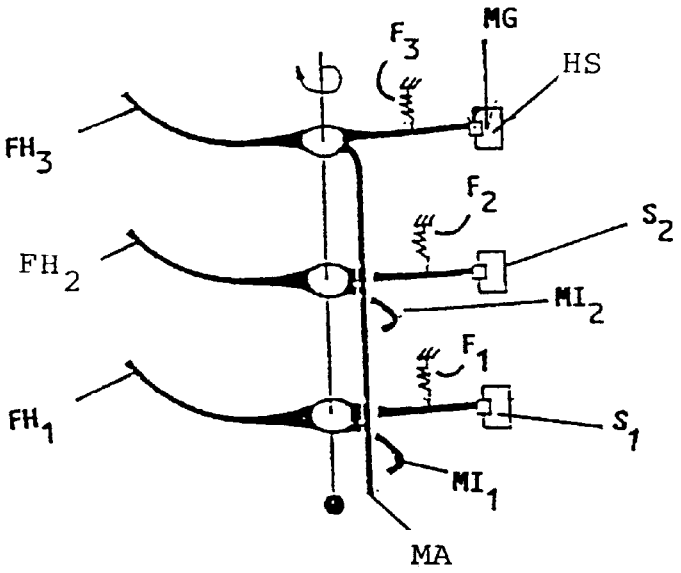
Figure 4:
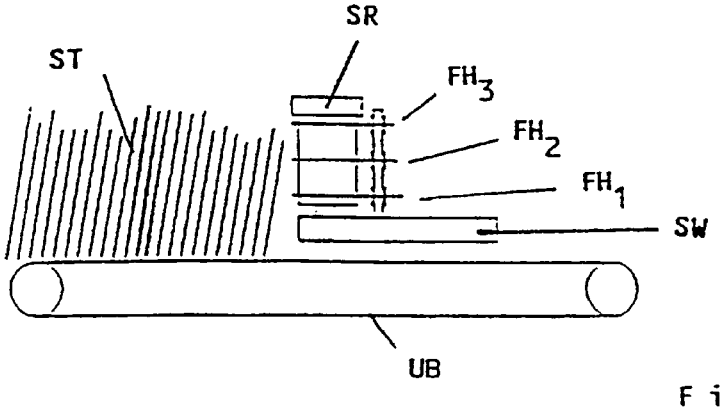
Figure 5:
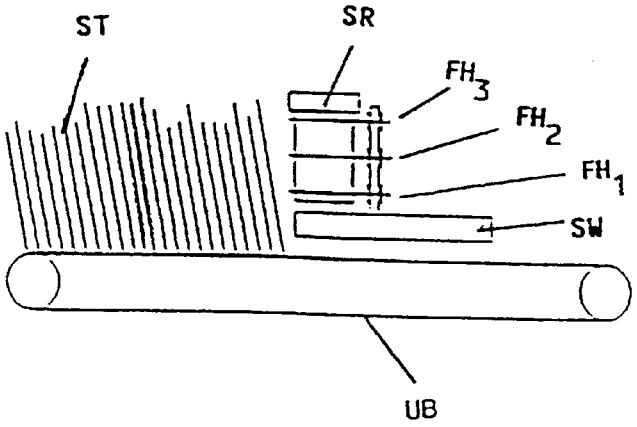

Shown are in:

FIG. 1 View from above of a known stacking carriage with stacking roller and a particularly preferred sensing lever arrangement;

FIG. 2 The schematic diagram of a particularly preferred intermediate stacking device according to the invention;

FIG. 3 A diagram, designed to illustrate an especially preferred combined effect of the sensing lever arrangement;

FIG. 4 A diagram to illustrate the slanted stack position toward the back; and FIG. 5 A diagram to illustrate the slanted stack position toward the front.

The items SE are conveyed, standing up and wedged in between the front belt V and the rear belt H, along the guide rollers $FR_2$, $FR_3$, $FR_4$, wherein the guide rails $LZ_1$, $LZ_2$ help with the guidance. The front belt V is guided around the guide roller $FR_4$, while the rear belt H is moved further in the direction of the stacking roller SR. Starting with the guide roller $FR_4$, an item previously located between the front belt V and the rear belt H is moved further in the direction of the stacking roller SR, owing to its inertial mass, is seized there by the stacking roller SR and is conveyed between the stacking roller SR and the stack of items ST to the stacking wall SW.

A stacking spiral SP seizes the item SE, preferably while it is passing by, and simultaneously pushes the item away from the rear belt H in the direction of the stack of items ST. The more items are stacked, the more the stacking carriage SW must be transported away from the withdrawing roller AR. The more items are taken off, the more the stacking carriage SW must be transported toward the withdrawing roller AR, so that the stack pressure is at an optimum for the following items SE to be stacked. The underlying belt UB is respectively moved with the motor $M_1$, such that the item SE closest to the withdrawing roller can be pulled off by the withdrawing roller. The control of motor $M_1$ is taken over by the electronic circuit ES. The control of the stacking carriage SW is described in the following:

A particularly preferred sensing lever arrangement FH has three levers $FH_1$, $FH_2$, $FH_3$, which are arranged one above the other in the same vertical position and are respectively pushed against the stack of items ST by the springs $F_1$, $F_2$, $F_3$. On the one hand, the levers $FH_1$ or $FH_2$ actuate the switches $S_1$ or $S_2$ while, on the other hand, they can press via their carriers $MI_1$ or $MI_2$ against the carrier stop MA of lever $FH_3$, depending on the position, and thus can help deflect the lever $FH_3$. At the end opposite the stack of items, the lever $FH_3$ is provided with magnet MG, which is moved past a Hall sensor HS. The lever $FH_3$ is deflected following the highest pressure exerted by the stack on one of the levers $FH_1$, $FH_2$, $FH_3$, and the magnet MG is thus placed in a specific position to the Hall sensor HS. The Hall sensor signal is converted in the electronic circuit ES into corresponding voltages for the direct current motor drive $M_2$, which drives the stacking carriage SW via a toothed belt Z. Thus, depending on the stack pressure, the stacking carriage is moved faster, slower or not at all.

The switching points for the switches $S_1$ and $S_2$ are in one plane to the underlying belt plane. If the upper switch $S_2$ reports "in" and the lower switch $S_1$ reports "out," then this indicates a slanted position toward the back (see FIG. 4). If the upper switch $S_2$ reports "out" and the lower switch $S_1$ reports "in," then this means a slanted position toward the front (see FIG. 5).

With a slanted position toward the back, the stack is preferably straightened again by moving the underlying belt UB and the stacking carriage SW briefly forward. With a slanted position toward the front, the stack ST is preferably straightened again by moving the underlying belt forward. During the time that a slanted position is recognized, the signals of the Hall sensor HS have no effect on the drive for motor $M_2$ and thus the movement of the stacking carriage SW.

The invention can be modified easily. Thus, a pressure measuring device and a device for detecting a slanted position can be used in place of the sensing lever arrangement, wherein the detection of the slanted position can be realized, for example, with two light barriers near the stacking roller, which are positioned one above the other and crosswise to the movement direction of the underlying belt UB, and wherein the slanted position is detected in that the light barriers display different conditions.

We claim:

1. A device for the intermediate stacking of items (SE), in particular in letter processing facilities, comprising a stacking roller (SR), a stacking carriage (SW), an underlying belt (UB), and a separating device, in which the stacking roller (SR) is arranged on the stacking carriage (SW) and in which a pressure measuring device is provided near the stacking roller for measuring the pressure exerted by the stack on the pressure measuring device, characterized in that a device is provided for detecting possible slanted positions of the stack of items (ST), once a slanted position is detected, the stacking carriage (SW) and/or the underlying belt (UB) are moved until the slanted position is corrected, the stacking carriage (SW) is moved along the underlying belt (UB) until the stack of items (ST) exerts a certain pressure onto the pressure measuring device, provided the device does not signal a slanted position.

2. A device according to claim 1, characterized in that the device for detecting possible slanted positions comprises two levers ($FH_1$, $FH_2$), positioned one above the other, which are pressed against the stack of items (ST), the levers respectively actuate one switch ($S_1$, $S_2$), wherein the switching points for the switches ($S_1$, $S_2$) are positioned on a perpendicular line to the underlying belt (UB) plane and a slanted position is detected if the switches ($S_1$, $S_2$) display different switch positions.

3. A device according to claim 2, characterized in that the two levers ($FH_1$, $FH_2$) respectively have one carrier ($MI_1$, $MI_2$), a third lever ($FH_3$) is attached in the same vertical position as the other two levers ($FH_1$, $FH_2$) and that this lever has a carrier stop (MA), the third lever ($FH_3$) has the same design as the two levers ($FH_1$, $FH_2$), with the exception of the carrier stop (MA) and the carriers ($MI_1$, $MI_2$), the third lever ($FH_3$) is a component of the device for measuring the pressure, existing near the stacking roller (SR) and exerted onto the pressure measuring device, a device for detecting the deflection of the lever ($FH_3$) is provided, the carriers ($MI_1$, $MI_2$) of the two levers ($FH_1$, $FH_2$) can press against the carrier stop (MA) of the third lever ($FH_3$).

4. A device according to claim 1, characterized in that an analog sensor (AS) for detecting the deflection of the third lever is provided.

5. A device according to claim 4, characterized in that the analog sensor (AS) is a Hall sensor.

6. A device according to claim 1, characterized in that an electronic circuit (ES) is provided for controlling the speed of the stacking carriage (SW) along the underlying belt (UB), in dependence on the position of the third lever ($FH_3$).

7. A device according to claim 1, characterized in that the separating device is designed as a withdrawal roller (AR).

8. A device according to claim 1, characterized in that the separating device is designed as withdrawal belt or withdrawal belts.

9. A process for erecting a stack, located inside a device according to claim 1, characterized in that for a slanted position of the stack (ST) toward the front, the stack (ST) is straightened again through a brief forward movement of the underlying belt (UB), for a slanted position of the stack (ST) toward the back, the stack (ST) is straightened once more through a forward movement of the underlying belt (UB) and the stacking carriage (SW).

* * * * *